US009593919B2

(12) United States Patent
Neff

(10) Patent No.: US 9,593,919 B2
(45) Date of Patent: Mar. 14, 2017

(54) METHOD AND APPARATUS FOR RAPID DEPLOYMENT OF A DESIRABLE MATERIAL OR CHEMICAL USING A PYROPHORIC SUBSTRATE

(71) Applicant: The United States of America as represented by the Secretary of the Navy, Washington, DC (US)

(72) Inventor: Daniel R Neff, Jasper, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 372 days.

(21) Appl. No.: 14/225,809

(22) Filed: Mar. 26, 2014

(65) Prior Publication Data

US 2014/0338654 A1 Nov. 20, 2014

Related U.S. Application Data

(60) Provisional application No. 61/811,157, filed on Apr. 12, 2013.

(51) Int. Cl.
*F41H 9/06* (2006.01)

(52) U.S. Cl.
CPC ..... *F41H 9/06* (2013.01)

(58) Field of Classification Search
USPC ..... 126/263.02
See application file for complete search history.

(56) References Cited

U.S. PATENT DOCUMENTS

| | | | | | |
|---|---|---|---|---|---|
| 3,068,756 | A * | 12/1962 | Schermuly | F42B 10/56 | 102/340 |
| 3,940,605 | A * | 2/1976 | Gerber | F21K 2/06 | 102/336 |
| 5,136,950 | A * | 8/1992 | Halpin | F42B 4/26 | 102/324 |
| 5,866,840 | A * | 2/1999 | Briere | F42B 4/26 | 102/336 |
| 2011/0308420 | A1* | 12/2011 | Mutascio | B22F 1/0007 | 102/513 |

* cited by examiner

*Primary Examiner* — Avinash Savani
(74) *Attorney, Agent, or Firm* — Christopher A. Monsey

(57) ABSTRACT

A system and method for deployment of a material or desirable product is included. A desirable product can include a combination of a pyrophoric material with a material adapted to be sublimated by pyrophoric effect and produce a desired effect such as, for example, type of dye configured to be an obscurant material with a desired effect after sublimation could be a visual obscurant, electromagnetic obscurant, or some type of pesticide. A system for deploying and storing the material could include a housing configured to seal the combination of dye and pyrophoric materials from the presence of oxygen so that the pyrophoric material does not react until selectively exposed to a gas. A selection and mix of the pyrophoric material with the material, e.g., dye can be accomplished in such a way that the reaction between the pyrophoric material and oxygen is not substantially impeded.

23 Claims, 3 Drawing Sheets

Bare Pyrophoric Substrate

Pyrophoric Substrate Coated With Dye

Pyrophoric Substrate Exposed to Air (Oxygen). (1) Generates Heat (2) Sublimes Dye

METHOD AND APPARATUS FOR RAPID DEPLOYMENT OF A DESIRABLE MATERIAL OR CHEMICAL USING A PYROPHORIC SUBSTRATE

CROSS-REFERENCE TO RELATED APPLICATIONS

The present application claims priority to U.S. Provisional Patent Application Ser. No. 61/811,157, filed Apr. 12, 2013, entitled "METHOD AND APPARATUS FOR RAPID DEPLOYMENT OF A DESIRABLE MATERIAL OR CHEMICAL USING A PYROPHORIC SUBSTRATE," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 102,520) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present invention relates to a system and method for rapid deployment of a material or desirable product. For example, many commercial applications utilize the basic principle of thermally heating a substance to change its physical state from a solid or liquid to a gas or aerosol. Many of these applications utilize a burning flame or pyrotechnic reaction, such as a candle or colored smoke, to generate an aerosol of a material to achieve a desired effect. Other applications utilize an electrical source to provide the thermal energy required to induce the phase change. One embodiment of the invention includes use of a pyrophoric substrate to generate the thermal energy required to produce an aerosol of a material to achieve a desired effect such as a scent, visual indication (e.g., rescue-need indicator), etc. Another application can be for diverting birds from a particular flight path. Another use is in meteorological application such as, e.g., cloud seeding. Another application would be to generate effects for air fresheners of bug bombs or disinfectants for rapid employment in infection control systems.

Another exemplary embodiment of the invention can generate a product or material capable of absorption of one segment of an electromagnetic spectrum which is facilitated by or compatible with emission of another electromagnetic spectrum segment. A variety of desirable applications for this capability are possible including testing applications where a particular test environment is desired. For example, a test facility can be created at low cost by using an embodiment of the invention to generate a desired test environment by rapid deployment of a desired product or material in a desired location are adjacent/in proximity with a particular structure. Other applications could include space systems where an augmented absorption or protective capability is needed such as in the case of a surge in electromagnetic radiation or damage to a protective structure of the spacecraft. Another application is a delivery technique for altering atmospheric conditions in order to achieve a desired end state such as introducing a material into an area adapted to absorb, block, or attenuate one or more segments of electromagnetic spectrum while being compatible with emitting on one or more other segments of an electromagnetic spectrum. Another potential application is a search and rescue function where an improved detection capability is needed due to a need for a different means for detection of a signaling party.

According to an illustrative embodiment of the present disclosure, an apparatus or method utilizes a pyrophoric substrate to carry, distribute, and vaporize a material, such as for example an organic dye, via modes such as sublimation to act in a blocking, absorbing, or attenuation mode. Other embodiments can also be adapted to produce emissions in other portions of the electromagnetic spectrum such as infrared, near-infrared, and visual spectrum.

According to a further illustrative embodiment of the present disclosure, another means for producing desired effects can incorporate use of an energy generating system adapted to rapidly distribute a blocking, absorbing, or attenuation material, e.g., organic dyes, over a volume of an area to achieve the blocking, absorbing or attenuation mode by changing the material's physical phase (e.g., solid to a gas) without destroying the material's chemical properties.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
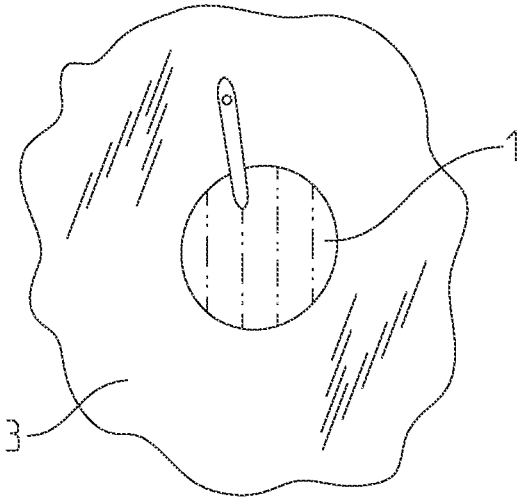
FIG. 1 is a diagram of a housing containing a pyrophoric materials combined with at least one materials producing a desired effect that is adapted to selectively be sublimated and introduced to a predetermined area according to an illustrative embodiment of the invention.

Referring to FIG. 1, one embodiment of this invention can include a pyrophoric substrate 1 impregnated or coated with a material or chemical of interest which is stored in a sealed delivery structure 3. Pyrophoric materials are substances that ignite or react instantly upon exposure to air, specifically oxygen. Such a reaction can generate enough heat for sufficient time to sublime or evaporate a variety of materials into a gas or a desirable aerosol.

For example, a delivery structure 3 can ensure a material or chemical of interest sublimates or disperses at a temperature that the pyrophoric substrate generates upon being exposed to another substance (e.g., atmospheric air or oxygen in a predetermined range). The delivery structure 3 is adapted to control activation or delivery of the material or chemical of interest so as to enable transportation, distribution, and/or vaporization of the desired material or chemical of interest. One example of a material or chemical of interest can include, e.g., organic dyes to provide e.g., a blocking, absorbing, or attenuation function.

In one embodiment, samples of pyrophoric materials 1 can be coated with typical organic dyes (i.e., oil reds, solvent yellow, solvent greens, etc.). An exemplary process for manufacturing an embodiment in accordance with the invention can include a manual coating process with an active pyrophoric metal that is coated with various levels of organic dyes while maintaining its pyrophoric nature (e.g., ensuring no oxygen comes in contact with the pyrophoric material during manufacturing). Upon exposure to oxygen (air), an exemplary pyrophoric substrate is capable of reacting and generated enough heat to vaporize the various dyes producing a colored smoke (See FIG. 2).

In another embodiment, upon exposure to oxygen (air), a pyrophoric material will heat up to a predetermined temperature and vaporize a coating or impregnated material of a desired product which is to be deployed in a particular area or environment. The heating of the pyrophoric materials can also act as an infrared source. Subsequent heating of the substrate also results in the vaporization of the selected coating which can be used to generate an obscuration or specific emission. Other materials could also be deposited on the pyrophoric substrate (without passivizing the surface), which vaporize upon exposure to heat to generate a specific emission in a band of interest.

An expendable device could even be tailored to produce heat (an infrared source) and act as an obscurant (e.g., blocking or smoke signal) to create redundant discoverable aspects that, e.g., a searcher could use to increase probability of finding a desired object of a search or a desired object of a search of a third party. Such desired objects or objectives can include lost parties or even a protective measure against being found in a search by undesired parties such as, e.g., wild animals or criminals.

A group of organic dyes were coated on the surface of a pyrophoric substrate. As the pyrophoric substrate heats upon exposure to air, the dye sublimes, generating an aerosol smoke. Beyond the UV obscuring application in which these dyes were being evaluated, this technology is also applicable as a non-explosive or a replacement for pyrotechnic visual smoke applications or distress signals. Improvements over conventional colored smoke clouds could include: increased or broader dissemination (larger cloud), rapid dissemination or cloud maturity (a couple seconds), and convenience for aerial dispersion. Beyond colored dyes, one could also envision commercial applications where the heat from a portable pyrophoric substrate could be used to sublime or evaporate other materials: scented waxes, scented oils, insect foggers, etc.

In particular, one exemplary embodiment of the invention includes an appropriate pyrophoric substrate that can sublime or evaporate the material or chemical of interest in order to achieve the desirable effect(s) (i.e. visual, fragrance, etc.) at a particular temperature range associated with the material or chemical of interest. For example, one embodiment can include an organic dye, which has a chemical structure effective at absorbing UV radiation, as one exemplary material or chemical of interest. In this example, a dye is adhered to a pyrophoric substrate in such a way as to allow the substrate to remain pyrophoric. A desirable manufacturing process in accordance with one embodiment of the invention would include determining or selecting a quantity of material or chemical of interest, e.g., organic dye and a method of application which would permit a pyrophoric material to maintain its pyrophoric properties such that it adequately sublimates or disperses the material or chemical of interest into and throughout a desired deployment area. Alternatively, a vessel or deployment structure can be constructed to position a pyrophoric substrate in close proximity to a material or chemical of interest, e.g., an organic dye versus physically coating the substrate. Exemplary embodiments of the invention are adapted to ensure a material or chemical of interest, e.g., organic dye, must sublime, not combust, during the thermal heating of the substrate.

For example, a group of materials or chemicals of interest e.g., organic dyes (solvent yellow, oil red, oil orange, etc.), were evaluated for the objectives discussed herein. A determination of a desired quantity of dye required can be dependent on a surface area of a deployment substrate. Too much organic dye could result in inefficient heating of the substrate and poor or incomplete sublimation of the dye. For example, 5.5 grams of solvent yellow organic dye and 50 grams of pyrophoric foils could be loaded into a container with in an inert, oxygen free, environment and sealed. The sealed container could then be removed from the inert environment and submitted to two minutes of mixing at 70% power on a mixing device, e.g., a RESODYN LABRAM® mixer. The container could then be removed from the mixer and placed back into the inert environment where the coated foils where removed and loaded into typical infrared generator hardware (aluminum case, piston, end cap) as shown in FIG. 3.

Figure 2:
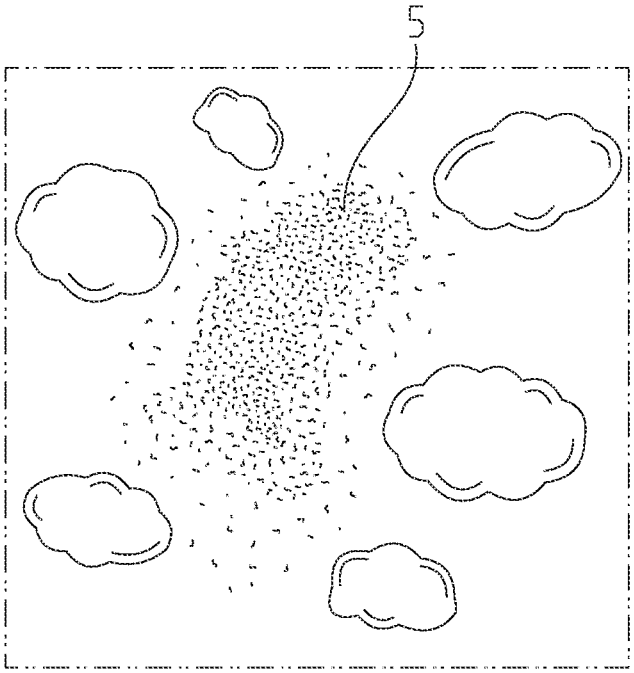
FIG. 2 is a diagram of a visual obscurant emitted from a deployment assembly according to an illustrative embodiment of the invention.
Figure 3:
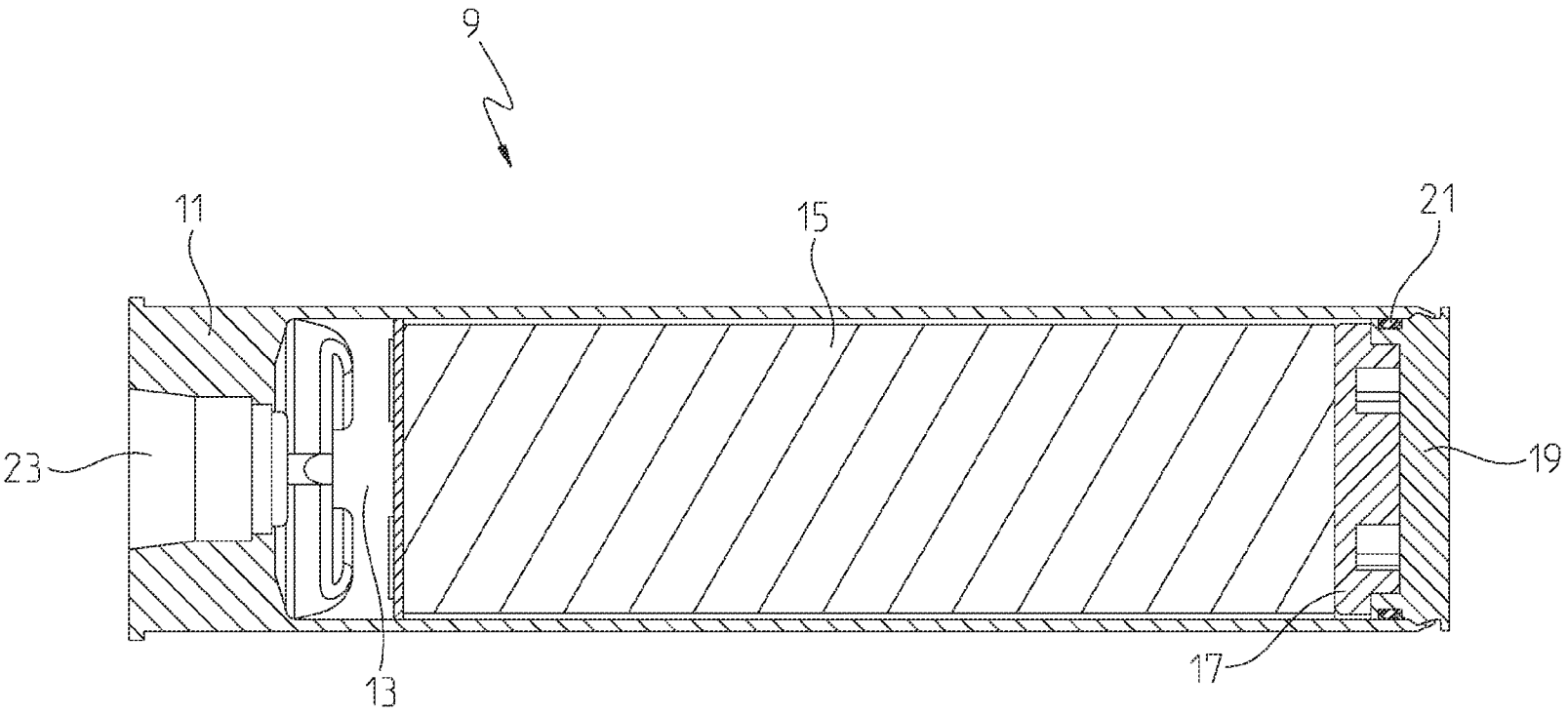
FIG. 3 is a diagram of a deployment assembly according to an illustrative embodiment of the invention.

Referring to FIG. 3, an assembly 9 is shown including a delivery structure loaded with a payload in accordance with one embodiment of the invention is shown. In particular, FIG. 3 shows an aluminum case 11 can be provisioned with an activation mechanism 23 (e.g., an impulse cartridge), loaded with a piston 13, four of the above referenced containers of a combination of pyrophoric substrate with a material or chemical of interest 15, e.g., organic dye coated pyrophoric material, a pad (assembly aid) 17, and secured with an o-ring sealed end cap 19. The assembly 9 also includes sealing structures, e.g., o-rings (not shown) which are provided to ensure the pyrophoric material remains sealed against external environments. In this embodiment, sealing structures include an o-ring 21 in end cap 19. An exemplary apparatus can alternatively include an ultraviolet obscuring, infrared emitting device that can be static or dynamically activated (payload ejected) with an impulse cartridge 23. For example, FIG. 2 shows one possible effect or emission from a FIG. 3 assembly.

Figure 4A:
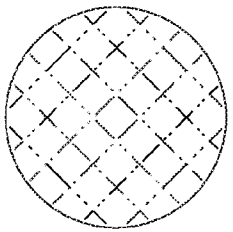
FIG. 4A shows one of a series of diagrams of a material associated with a pyrophoric material showing a sequence of states according to an illustrative embodiment of the invention.
Figure 4B:
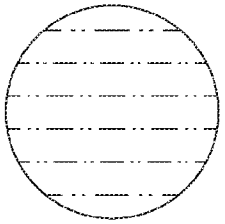
FIG. 4B shows one of a series of diagrams of a material associated with a pyrophoric material showing a sequence of states according to an illustrative embodiment of the invention.
Figure 4C:
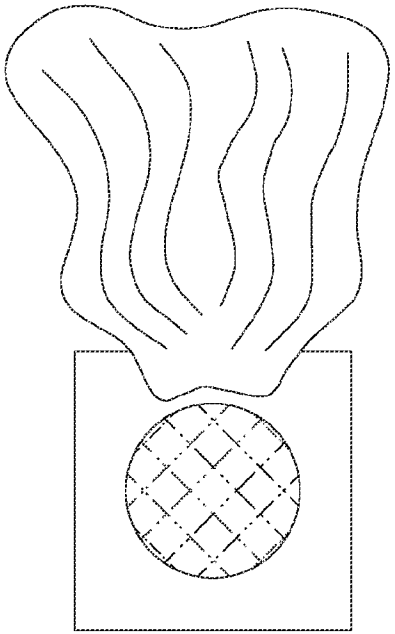
FIG. 4C shows one of a series of diagrams of a material associated with a pyrophoric material showing a sequence of states according to an illustrative embodiment of the invention.

FIGS. 4A, 4B, and 4C shows three stages of one simplified example embodiment of the invention. FIG. 4A shows a pyrophoric substrate at one phase of manufacturing of an embodiment of the invention. FIG. 4B shows the FIG. 4A substrate coated with a material or chemical of interest (e.g., a material or chemical of interest that produces a desired effect (e.g., organic dye which absorbs ultraviolet radiation) having a sublimation temperature within a range that the pyrophoric material reaction temperature). FIG. 4C shows the FIG. 4B coated substrate exposed to a pyrophoric reactant e.g., oxygen and emitting sublimated material.

A method of manufacturing one embodiment of the invention can include Step 31 determining a desired effect or result. For example, a desired effect can include a sensor, detection, or receptor attribute such as a scent, pesticide, visual, obscurant, or electromagnetic effect. At Step 33, selection of a material that has an effect as described at Step 31. At Step 35, formulate a pyrophoric material which produces a temperature-time profile that the material selected at Step 31 sublimates at over a predetermined time period. At Step 37, manufacturing a pyrophoric material assembly by integrating the pyrophoric material selected at Step 35 with the material selected at Step 31. At Step 39, providing a delivery assembly comprising a container, activation mechanism, piston, and sealing structures adapted to store and activate the pyrophoric material assembly created at Step 37 and loading the pyrophoric material assembly in the delivery assembly.

Organic dyes used in one or more embodiments of the invention can include Quinoline Yellow Dye ($C_{18}H_{11}NO_2$), Solvent Red 135 Dye ($C_{18}H_6C_{14}N_{2O}$), Solvent Red 1 Dye ($C_{17}H_{14}N_2O_2$).

Alternative embodiments can include a system adapted to absorb radiation that can be rapidly deployed such as a radiation blocking airbag that can be used in, for example, space applications. One embodiment can, for example, have an invention as described, above which operate within a bag or flexible/expandable enclosure or a cavity where a gas selected to interact with a selected pyrophoric is introduced into contact with the pyrophoric structure as described herein. The pyrophoric structure will then sublimate a material of interest e.g., material which blocks selected radiation (e.g., from a radiation event in space). In another example, a radiation blocking structure can be positioned relation to a structure of interest which can emit selected radiation which an embodiment of the invention can be adapted and operable to block on occurrence of a predetermined event such as a radiation emission incident. In such a way, additional radiation blocking structures can be rapidly deployed. Another possibility is that an embodiment of the invention can be used to block radiation from specific vectors or orientations to a structure of interest such as a radio telescope deployed in space. In such a case, volume of a spacecraft is at a premium thus having a deployable system which is expandable and thus reduces a physical profile or footprint of a spacecraft is highly valuable given a launch system payload bay can be smaller. Thus, one embodiment of the invention can include as an additional or different component such an expandable structure which can permit the invention to produce a desired sublimated output into a containment structure either within the Earth's atmosphere or outside it.

Although the invention has been described in detail with reference to certain preferred embodiments, variations and modifications exist within the spirit and scope of the invention as described and defined in the following claims.

The invention claimed is:

1. A deployment apparatus comprising:

a substrate having pyrophoric properties configured to react upon exposure to a gas;

a material coating, impregnating, or provided in proximity to said substrate operable to sublimate or disperse at a temperature generated by the substrate and thereby create a colored obscurant; and a structure and initiation mechanism configured to seal said material and said substrate in a chemically inert environment such that the structure and initiation mechanism can selectively control or initiate said reaction to said gas;

wherein said reaction generates said heat in a range adapted to sublimate said material;

wherein said material and substrate are adapted to produce a sublimated output adapted for blocking, absorbing, or attenuating electromagnetic energy comprising at least ultraviolet or visual spectrum.

2. A deployment apparatus as in claim 1, wherein the material is an organic dye.

3. A deployment apparatus as in claim 1, wherein the gas is oxygen.

4. A deployment apparatus as in claim 1, wherein the substrate is impregnated with the material.

5. A deployment apparatus as in claim 1, wherein the substrate is coated with the material in such a way as to not impede the substrates ability to react with oxygen.

6. A deployment apparatus as in claim 1, wherein the structure seals said material and said substrate from oxygen such that substrate does not react and generate heat.

7. A deployment apparatus as in claim 1, wherein the structure enables the storing, transportation, distribution, and vaporization of the material and substrate.

8. A deployment apparatus as in claim 1, wherein the reaction of the substrate is capable of generating enough heat to vaporize the material producing a colored smoke.

9. A deployment apparatus as in claim 1, wherein the reaction of the substrate with oxygen is adapted to be an infrared source that can be detected by an infrared detector.

10. A deployment apparatus as in claim 1, wherein the material, once sublimated or evaporated, can be used to generate an obscuration or specific emission in a frequency band of interest.

11. A deployment apparatus as in claim 1, wherein the substrate is adapted to sublimate the material such that a desirable visual or fragrant effect is produced.

12. An assembly of a deployment apparatus comprising:

a casing adapted to house a variety of components;

a container housed inside the casing configured to hold a material, wherein the material comprises a pyrophoric material coated with an organic dye, wherein said pyrophoric material and said organic dye are selected so as to sublimate the organic dye into an aerosol that absorbs ultraviolet spectrum electromagnetic energy;

a mechanism housed inside the casing configured to initiate a mechanical process that can eject the container from the casing, wherein the mechanism contains a piston adapted to force the container out of the casing;

a structure fixed at one end of the casing and the container adapted to seal the container in the casing; and wherein the structure is further adapted to seal the material within the container in a chemically inert environment.

13. An assembly of a deployment apparatus as in claim 12, wherein the casing is made of aluminum.

14. An assembly of a deployment apparatus as in claim 12, wherein the structure is further adapted to seal the material from the presence of oxygen such that the material with pyrophoric materials does not react until expelled from the container by said piston.

15. An assembly of a deployment apparatus as in claim 12, wherein the material is made up of said pyrophoric material and said dye and the pyrophoric material is configured to generate heat when introduced to the presence of oxygen and cause the dye to sublimate allowing the dye to create an obscurant cloud.

16. An assembly of a deployment apparatus as in claim 12, wherein the material creates a visual obscurant, such as smoke.

17. An assembly of a deployment apparatus as in claim 12, wherein said organic dye comprises one of Quinoline Yellow Dye, Solvent Red 135 Dye, or Solvent Red 1 Dye.

18. An assembly of a deployment apparatus as in claim 12, wherein the structure comprises a pad adapted to hold the material within the container.

19. An assembly of a deployment apparatus as in claim 12, wherein the structure is an o-ring adapted for sealing the contents of the casing inside the casing.

20. An assembly of a deployment apparatus as in claim 12, wherein a second structure is further provided at a common end of the casing as the first structure, wherein the second structure is adapted to ensure that the material remains sealed against external environments prior to deployment.

21. An assembly of a deployment apparatus as in claim 12, wherein the structure seals the system enclosed in the casing using a pad adapted to hold the material into the container, an end cap adapted to hold the container in the casing, and an o-ring adapted to complete sealing of both the pad and the end cap.

22. A method of manufacture for an obscurant deployment apparatus comprising the steps of:

providing a material comprising an organic dye that produces an obscuring effect when sublimated, wherein said obscuring effect comprising an ultraviolet electromagnetic spectrum obscurant effect;

providing a pyrophoric material configured to produce a temperature-time profile that causes the material to sublimate over a predetermined time period;

integrating the material and the pyrophoric material together in an environment substantially free from oxygen such that the pyrophoric material does not react until deployed or ejected from the deployment apparatus;

providing a delivery assembly comprising a container, an activation mechanism, a piston, and sealing structures adapted to store and activate the pyrophoric material; and loading the integrated pyrophoric material and material into the delivery assembly.

23. A deployment apparatus as in claim 1, further comprising an expandable containment structure coupled to an output section of said structure and initiation mechanism, wherein said expandable containment structure is adapted to expand upon output of said sublimated output and position said sublimated output with regard to a source of said electromagnetic energy.

* * * * *